US006575490B1

(12) United States Patent
Laughlin

(10) Patent No.: US 6,575,490 B1
(45) Date of Patent: Jun. 10, 2003

(54) ADJUSTABLE PAD FOR FOOT BINDING

(75) Inventor: James Laughlin, Burlington, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/561,007

(22) Filed: Apr. 28, 2000

(51) Int. Cl.[7] ..... A63C 9/082

(52) U.S. Cl. ..... 280/618; 280/617; 280/14.24; 280/607

(58) Field of Search ..... 280/618, 624, 280/14.2, 613, 626, 636, 633, 11.14, 11.36, 11.3, 11.33, 11.26, 11.16, 603, 600, 607, 617, 616, 620; 36/97; 428/160; 441/70, 74

(56) References Cited

U.S. PATENT DOCUMENTS

| | | | | |
|---|---|---|---|---|
| 2,970,325 A | * | 2/1961 | Moline et al. | 441/70 |
| 3,137,014 A | * | 6/1964 | Meucci | 441/70 |
| 3,675,938 A | | 7/1972 | Sigl | |
| 3,817,543 A | | 6/1974 | Haff | |
| 4,067,593 A | | 1/1978 | Earl | |
| 4,083,128 A | * | 4/1978 | Rossman | 36/97 |
| 4,085,947 A | | 4/1978 | Sarver | |
| 4,160,556 A | | 7/1979 | Gertsch | |
| 4,505,493 A | | 3/1985 | Gustavsson | |
| 4,568,296 A | | 2/1986 | Newell | |
| 4,586,727 A | | 5/1986 | Andrieu et al. | |
| 4,699,398 A | | 10/1987 | Luschnig et al. | |
| 4,802,687 A | | 2/1989 | Shimizu | |
| 4,836,571 A | * | 6/1989 | Corbisiero | 280/603 |
| 4,909,768 A | | 3/1990 | O'Brien | |
| 5,029,575 A | * | 7/1991 | Zhivotchenko et al. | 36/97 |
| 5,044,656 A | | 9/1991 | Peyre | |
| 5,125,680 A | | 6/1992 | Bejean et al. | |
| 5,188,386 A | | 2/1993 | Schweizer | |
| 5,282,642 A | | 2/1994 | Provence | |
| 5,344,179 A | | 9/1994 | Fritschi et al. | |
| 5,431,427 A | | 7/1995 | Pieber et al. | |
| 5,499,837 A | * | 3/1996 | Hale et al. | 280/607 |
| 5,503,900 A | | 4/1996 | Fletcher | |
| 5,513,872 A | | 5/1996 | Arduin et al. | |
| 5,566,966 A | | 10/1996 | Couderc et al. | |
| 5,664,797 A | | 9/1997 | Haughlin | |
| 5,803,479 A | | 9/1998 | Meyer et al. | |
| 5,836,592 A | * | 11/1998 | Chang | 280/11.3 |
| 5,845,923 A | | 12/1998 | Zanco | |
| 5,901,975 A | | 5/1999 | Phipps | |
| 5,909,894 A | | 6/1999 | Meader et al. | |

(List continued on next page.)

FOREIGN PATENT DOCUMENTS

| | | |
|---|---|---|
| CH | 670 769 A5 | 7/1989 |
| DE | 196 03 790 A | 4/1997 |
| DE | 198 45 467 A | 4/1999 |
| EP | 0 398 794 A | 11/1990 |
| FR | 2 626 189 A | 7/1989 |
| FR | 2 742 345 | 12/1995 |
| JP | 3070043 | 7/2000 |
| WO | WO 94 25125 A | 11/1994 |
| WO | WO 98 42419 A | 10/1998 |
| WO | WO 99 15245 A | 4/1999 |

OTHER PUBLICATIONS

Elan Snowboards—Conventional Bindings, pp. 1–2 (Internet Printout).

Joyride Bindings 2000, page 1 (Internet Printout).

*Primary Examiner*—Brian L. Johnson
*Assistant Examiner*—Hau Phan
(74) *Attorney, Agent, or Firm*—Wolf, Greenfield & Sacks, P.C.

(57) ABSTRACT

A method and apparatus for adjusting a position of a pad on a binding base. A pad can be adjusted to any one of an infinite number of positions relative to a binding base and/or without the use of tools. Adjustment can be provided by a drive mechanism, or by a locking device mounted to the pad that engages with the base.

47 Claims, 4 Drawing Sheets

U.S. PATENT DOCUMENTS 5,947,781 A 9/1999 VonWald et al.
5,971,407 A 10/1999 Zemke et al.
5,992,872 A 11/1999 Proctor
5,992,873 A 11/1999 Hauglin
6,056,310 A 5/2000 Hangl
6,102,429 A * 8/2000 Laughlin et al. ..... 280/617
6,105,992 A * 8/2000 Schaller et al. ..... 280/613
6,315,305 B1 11/2001 Gien

* cited by examiner

ADJUSTABLE PAD FOR FOOT BINDING

FIELD OF THE INVENTION

This invention relates to an adjustable pad for a foot binding.

BACKGROUND OF THE INVENTION

Bindings of various types and configurations are commonly used to attach a rider's foot to a snowboard. These bindings attach the rider's foot to the snowboard in a variety of ways, such as by tightening a strap extended over the rider's foot or by engaging with the bottom or side of the rider's boot, as in "step-in" bindings.

Regardless of how the rider's foot is attached to the snowboard, the bindings typically have a toe pad and/or a heel pad that is attached to the binding base and is positioned relative to a toe or heel portion of the rider's boot. The pads may provide comfort for the rider, prevent slipping of the rider's boot, accommodate different sized boots or binding bases, or improve the response of the snowboard when a rider turns by transferring force on the pad to the snowboard.

U.S. Pat. No. 5,503,900 to Fletcher describes heel and toe pads for a snowboard binding that can be attached to a binding base. The heel and toe pads can be attached to the snowboard, for example, by an adhesive or screws. Pads attached by adhesive may be peeled away from the binding base and reattached to the base at another location.

The assignee of the present application has developed a snowboard binding base and toe pad that can be adjusted on the base without tools. The toe pad has a slot that receives a front end of the base and engages with teeth on an underside of the base. Once the base is mounted to a snowboard, the toe pad is locked in place relative to the base by the teeth. Thus, the toe pad can only be adjusted relative to the base by removing the binding base from the snowboard so that the toe pad can be disengaged from the teeth and moved to a new position relative to the base.

SUMMARY OF THE INVENTION

One illustrative embodiment of the invention provides a snowboard binding having a base adapted to be mounted on a snowboard and to receive a rider's foot, a pad mounted to the base, and a drive mechanism that drives the pad relative to the base.

Another illustrative embodiment provides a snowboard binding having a base adapted to be mounted on a snowboard and to support a bottom of a rider's foot. The base includes a bottom having a bottom surface to contact an upper surface of a snowboard, and a top surface opposite the bottom surface and near a bottom of a rider's foot supported by the base. The binding also includes a pad mounted to the base, and a positioner that positions the pad relative to the base. The positioner is positioned entirely between planes including the top and bottom surfaces.

Another illustrative embodiment provides a snowboard binding having a base adapted to be mounted on a snowboard and to receive a rider's foot, a pad mounted to the base, and a pad positioner that positions the pad relative to the base while the base is attached to the snowboard, without tools and without dismounting the pad from the base.

Yet another illustrative embodiment of the invention provides a method for adjusting a pad on a snowboard binding. The pad is adjusted by providing a binding having a base attached to a snowboard, providing a pad mounted to the base, and positioning the pad relative to the base while the base is attached to the snowboard, without tools and without dismounting the pad from the base.

BRIEF DESCRIPTION OF THE DRAWINGS

Embodiments of the invention are described with reference to the following drawings, in which like numerals reference like elements, and wherein.

DETAILED DESCRIPTION

Illustrative embodiments of the invention provide a snowboard binding having an adjustable toe pad that can be adjusted along a heel-to-toe direction without the use of tools while the snowboard binding is attached to a snowboard and without dismounting the pad from the binding. In one illustrative embodiment, the toe pad may be adjusted to any one of an infinite number of heel-to-toe positions relative to a binding base using a pad drive system. In another illustrative embodiment, the toe pad may be adjusted relative to a binding base by actuating a locking mechanism in the toe pad. Although the embodiments described below relate to adjusting a toe pad on a binding base, it should be understood that the invention is not limited to pads located near a toe end of a binding. Instead, the invention may be used without regard to the pad location, and may be used with heel pads, or other support devices used to improve the comfort, performance or other features of a binding.

Figure 1:
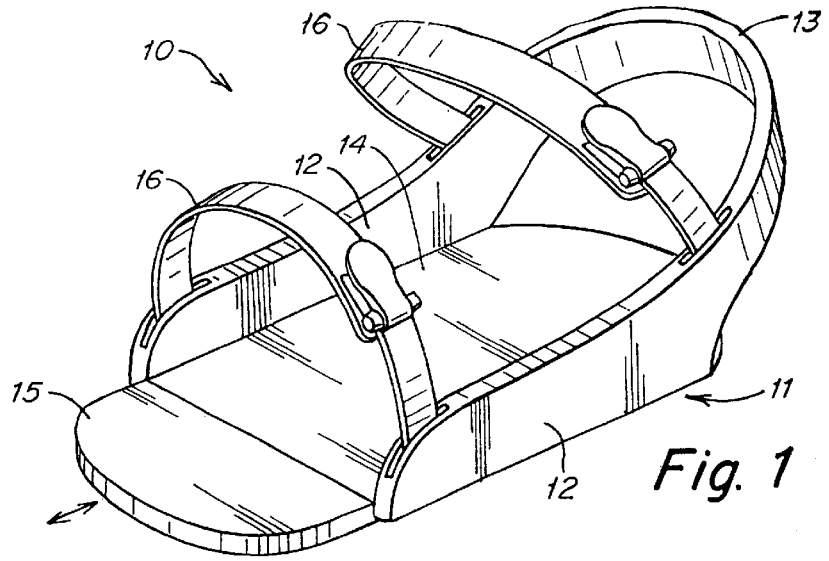
FIG. 1 is a perspective view of a snowboard binding having an infinitely adjustable and/or tool-free adjustable toe pad.

In a first illustrative embodiment, FIG. 1 shows a binding 10 having a base 11. In this embodiment, the base 11 includes a bottom 14 that is adapted to be attached to a snowboard. Thus, the bottom 14 can include one or more holes that are used to fix the base 11 to the snowboard. For example, the bottom 14 can include a single hole adapted to engage with a conventional hold-down disk, as is well known in the art. The bottom 14 may alternately include two or more holes that are used to attach the bottom 14 to a snowboard with screws. However, the invention is not limited in the way that the base 11 is attached to a snowboard. Rather, the base 11 could be attached to the snowboard in any suitable way.

In the embodiment in FIG. 1, the base 11 includes side walls 12 that are attached to and extend upwardly from the bottom 14. The side walls 12 extend upwardly away from the bottom 14 and join together to form a heel loop 13 at a heel end of the base 11. A pair of straps 16 are attached to the side walls 12 and are used to attach a rider's foot to the base 11. At the toe end of the base 11, a toe pad 15 is mounted so that the toe pad 15 can be adjusted along at least a heel-to-toe direction using a positioner (not shown) mounted between the toe pad 15 and the base 11. As discussed in more detail below, the positioner can be a drive mechanism, a locking device or any other device that provides for adjustable positioning of the toe pad 15 relative to the base 11. Thus, the toe pad 15 may be optimally adjusted based on a rider's criteria, e.g., the toe pad 15 may be adjusted so that the toe pad 15 is nearly in contact with the toe portion of the sole of the rider's boot when the rider is not executing a toe side turn, to accommodate the length and/or upward curvature of the sole of the rider's boot, etc.

It should be understood that the binding 10 shown in FIG. 1 is only one example of a binding 10. That is, the binding 10 need not necessarily have side walls 12, a heel loop 13, and/or straps 16. Instead, the binding 10 could be a step-in type of binding that does not include straps 16 and/or side walls 12. Thus, an alternate type of binding device, e.g., one that engages with a bottom and/or side of the rider's boots, can be attached to the bottom 14 in place of the side walls 12, the heel loop 13 and/or strap 16. In addition, the binding 10 may include additional features that are known in the art and are not shown in FIG. 1. For example, the binding 10 may include a high-back that is attached to the heel loop 13 and/or the side walls 12, or other devices or features. Since these optional features are not essential to the invention, and the invention is not limited in any way by these features of the binding 10, the features are not further described in detail.

The invention is also not limited to the size, shape or other characteristics of the toe pad 15 (or any other pad). Thus, the toe pad 15 (or other adjustable pad) may be made more narrow, e.g., to allow for more side-to-side movement relative to the base 11, shorter in the heel-to-toe direction, thinner or thicker or have a varying thickness, etc.

Figure 2:
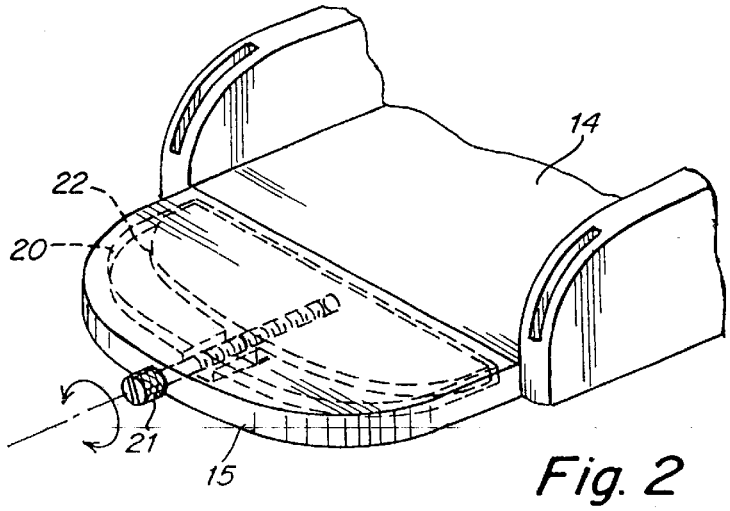
FIG. 2 is an assembled perspective view of an adjustable toe pad having an adjustable screw according to one illustrative embodiment of the invention.

FIG. 2 shows an illustrative embodiment of a toe pad 15 that can be adjusted along a heel-to-toe direction by a drive mechanism, such as a screw 21. The screw 21 is rotatably mounted to the toe pad 15 and includes a knurled head that may be rotated by a thumb and forefinger. The screw 21 head may also include a slot or other feature that can be engaged with by a tool, such as a coin, screwdriver, hex wrench, box wrench, and the like. The screw 21 can be formed of metal or be a molded plastic part, e.g., the screw 21 may be molded with the toe pad 15. The screw 21 may have conventional threads, or have one or more other helical features, such as that found in a worm gear, in place of conventional threads. The screw 21 is mounted to the toe pad 15 so that the screw 21 may rotate, but may not be easily pulled out of the toe pad 15 along the screw's longitudinal axis. This feature allows the screw 21 to drive the toe pad 15 in both heel and toe directions relative to the base 11. In this example, the bottom 14 of the base 11 includes an extension 22 that is received within a slot 20 formed in the toe pad 15. Insertion of the extension 22 into the slot 20 can aid in more securely fastening the toe pad 15 to the base 11 and/or guide the movement of the toe pad 15 relative to the bottom 14.

Figure 3:
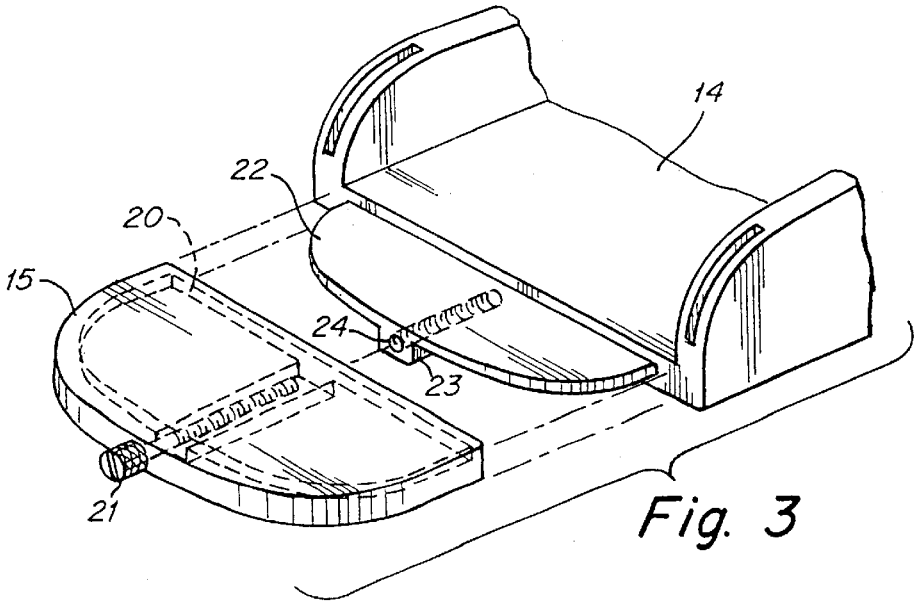
FIG. 3 is an exploded perspective view of the snowboard binding of FIG. 2.

FIG. 3 shows an exploded view of the FIG. 2 embodiment. The extension 22 is a tongue-like extension from the bottom 14 that has a block 23 extending downwardly from the extension 22. The block 23 includes a threaded hole 24 that engages with a leading end of the screw 21. Therefore, rotation of the screw 21 causes the screw 21 to move in a heel-to-toe direction, thereby causing the toe pad 15 to move in a heel-to-toe direction relative to the bottom 14. Since the toe pad 15 moves based on the rotation of the screw 21, the toe pad 15 can move to any one of an infinite number of possible positions.

Figure 4:
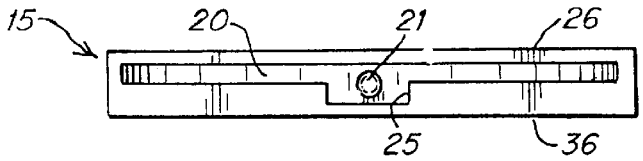
FIG. 4 is a heel-end view of the toe pad shown in FIG. 2.

FIG. 4 shows a heel end view of the toe pad 15 of FIGS. 2 and 3. The slot 20 extends substantially across the width of the toe pad 15, and a channel 25 is formed near a center of the toe pad 15. The channel 25 is shaped and sized to receive the block 23 on the extension 22. The upper surface 26 of the toe pad 15 is shown in this embodiment as being substantially flat, but the upper surface 26 may have any desired shape and/or include any desired features. For example, the upper surface 26 may have an inclined portion such that a front end of the upper surface 26 curves upward to meet a toe area of a rider's boot. The upper surface 26 may also include grooves or other friction-enhancing features to help prevent slipping of the rider's boot on the upper surface 26. Features on the upper surface 26 may also include designs or other non-functional aspects, as the invention is not limited in any way by the shape, features or other aspects of the upper surface 26. An under surface 36 of the toe pad 15 may be flat to contact an upper surface of a snowboard, or may have other configurations to contact portions of the base 11.

Although the embodiment shown in FIGS. 2 and 3 includes only a single screw 21, two or more screws could be used. Further, the screws may be oriented at an angle to each other to provide adjustment in both a heel-to-toe direction, as well as along a side-to-side or up and down direction. The screw 21 and the threaded hole 24 may be configured to allow easy rotation of the screw 21 in the threaded hole 24. Alternately, the threaded hole 24 may incorporate a self-locking feature that prevents the screw 21 from being rotated within the threaded hole 24 unless more than a threshold amount of torque is applied to the screw 21. For example, the base 11 may include a resilient member, e.g., a plastic ring, fixed relative to the threaded hole 24 and through which the screw 21 passes. A hole in the resilient member through which the screw 21 passes may be smaller than the diameter of the threaded hole 24 so that the screw 21 deforms the resilient member when passing through. This deformation may cause a relatively higher frictional force to be present between the resilient member and the screw 21 than is present between the screw 21 and the threaded hole 23. This self-locking feature may prevent unwanted rotation of the screw 21, e.g., rotation due to vibration during snowboard use. Other suitable devices or arrangements to prevent unwanted or inadvertent rotation of the screw 21 may be used.

Figure 5:
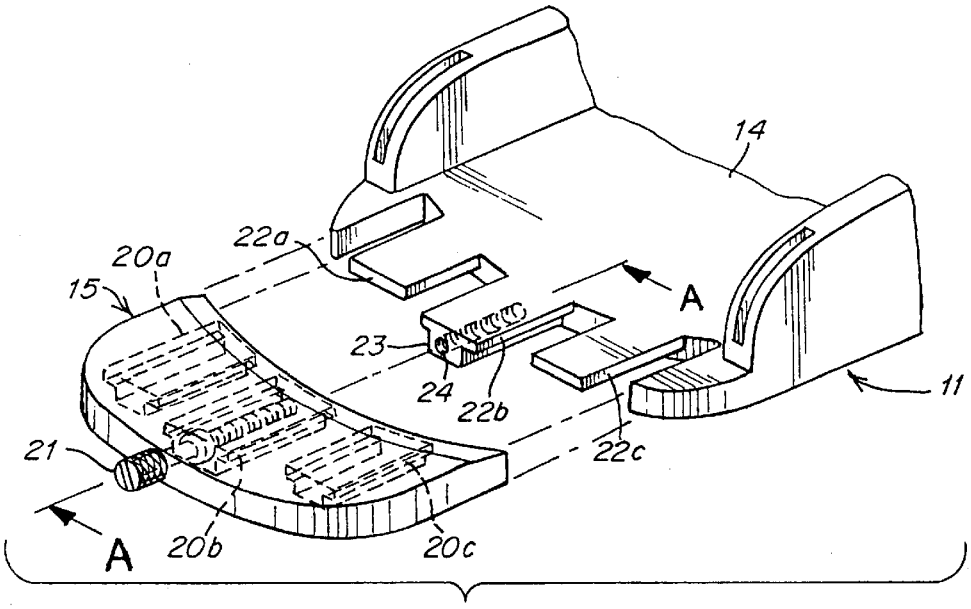
FIG. 5 is an exploded perspective view of a toe pad having an adjusting screw and a plurality of slots to receive finger extensions of the base in accordance with another illustrative embodiment of the invention.

FIG. 5 shows another illustrative embodiment in which a bottom 14 of the base 11 has three finger extensions 22*a*, 22*b* and 22*c*. A center finger extension 22*b* includes a block 23 with a threaded hole 24 that engages with the screw 21. The toe pad 15 includes three slots 20*a*, 20*b*, and 20*c* that each receives the finger extensions 22*a*, 22*b* and 22*c*, respectively. The finger extensions 22*a*–22*c* may fit closely within a corresponding slot 20*a*–20*c* to help accurately guide the movement of the toe pad 15 and/or prevent upward movement of the toe pad 15, e.g., movement away from a snowboard upper surface.

Figure 6:
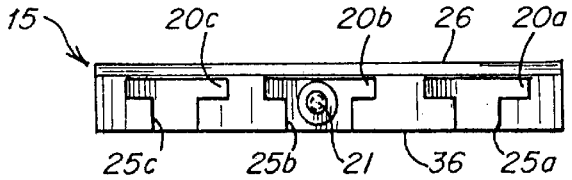
FIG. 6 is a heel-end view of the toe pad of FIG. 5.

FIG. 6 shows a heel-end view of the toe pad 15 of FIG. 5. Each of the slots 20*a*–20*c* communicates with a channel 25*a*–25*c*. The channels 25*a* and 25*c* may receive ribs, teeth or other features (not shown) on an undersurface of the finger extensions 22*a* and 22*c*. The channel 25*b* is configured to receive the block 23.

Figure 7:
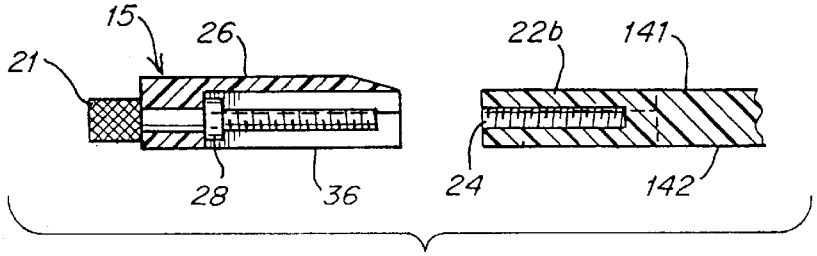
FIG. 7 is a cross-sectional side view along the line A—A of the embodiment of FIG. 5.

FIG. 7 shows a cross-sectional view of the embodiment shown in FIG. 5 along the line A—A. The screw 21 has a shoulder 28 that prevents pull out of the screw 21 from the toe pad 15. Thus, as the screw 21 is screwed into the threaded hole 24, a head of the screw 21 pushes the toe pad 15 toward the heel end of the base 11. As the screw 21 is screwed out of the threaded hole 24, the shoulder 28 pushes the toe pad 15 away from the base 11. The upper surface 26 of the toe pad 15 in the embodiment shown in FIG. 7 includes an inclined section near a heel side of the toe pad 15. This is only one example of many possible configurations for the upper surface 26, as discussed above. In addition, the bottom 14 of the base 11 could have one of more tapered portions, steps or other features near the joint between the upper surface 26 of the toe pad 15 and the bottom 14. For example, the bottom 14 could include lines, grooves or other features that indicate a position of the toe pad 15 relative to the bottom 14.

In the illustrative embodiments shown in FIGS. 2–7, the drive mechanism, i.e., the screw 21, is positioned between a top surface 141 of the bottom 14 of the base 11, and a bottom surface 142 of the base 11. The top surface 141 of the bottom 14 is typically the surface exposed to the rider's boot, whereas the bottom surface 142 typically contacts a snowboard. Positioning the drive mechanism between the top and bottom surfaces 141, 142 may prevent foreign matter, such as snow, ice or dirt, from interfering with the drive mechanism, and also may hide the drive mechanism from view.

In the illustrative embodiments shown in FIGS. 2–7, an under surface 36 of the toe pad 15 is positioned under the extension 22 or extensions 22*a*–22*c* and may contact an upper surface of a snowboard (not shown) when the binding 10 is attached. Such a configuration may improve the responsiveness of the snowboard when a rider moves to a toe-side turn, since force of the rider's boot on the toe pad 15 may be more directly and quickly transmitted to the toe-side edge of the snowboard. However, the toe pad 15 need not necessarily contact the snowboard when the binding 10 is attached. Instead, the toe pad 15 could rest on the extension 22 and/or the bottom 14 alone. Force on the toe pad 15 could then be transmitted through the toe pad 15 to the base 11 and then to the snowboard.

Figure 8:
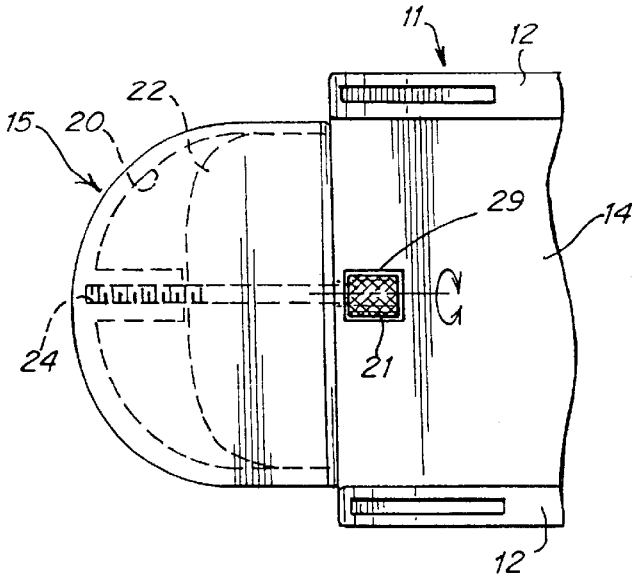
FIG. 8 is a top view of a snowboard binding in which an adjusting screw is mounted to a base in accordance with another illustrative embodiment of the invention.

FIG. 8 shows another illustrative embodiment in which a screw 21 is rotatably mounted to a bottom 14 of a base 11. A threaded end of the screw 21 extends toward a toe end of the base 11 and engages with a threaded hole 24 in the toe pad 15. As with the other embodiments described above, the threaded hole 24 may be formed within a nut or other threaded insert that is molded into or otherwise attached to the toe pad 15, rather than be a threaded hole formed within the toe pad 15 material. A knurled head end of the screw 21 is positioned within a recess 29 in the bottom 14 so that the screw 21 does not interfere with a rider's boot and so that the screw 21 can be rotated, e.g., by a rider's thumb.

Figure 9:
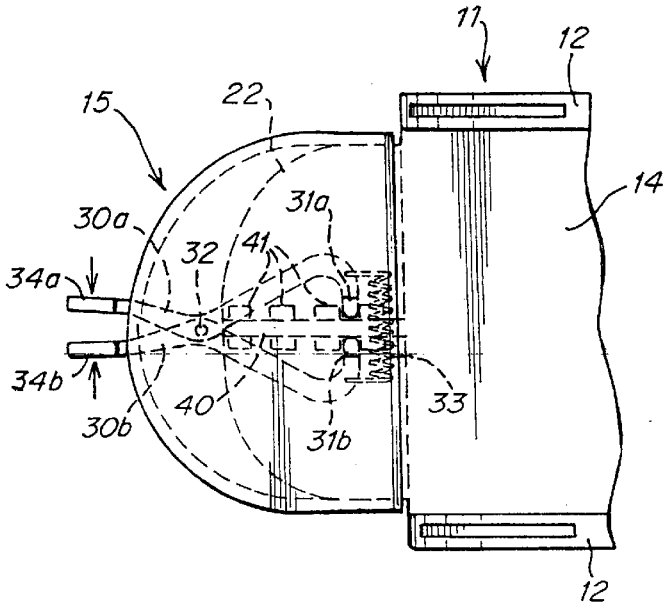
FIG. 9 is a schematic top view of a snowboard binding having a pair of manually-operated locking pins in accordance with yet another embodiment of the invention.

FIG. 9 shows another illustrative embodiment that provides a locking device used to adjust of the toe pad 15 on a base 11 either in a tool-free manner, or by using a tool. A pair of locking pins 30*a* and 30*b* each has an engaging portion 31*a* and 31*b* and are pivotally mounted to a pin 32. A spring 33 connected to the engaging portions 31*a* and 31*a* urges the engaging portions 31*a* and 31*b* toward each other. By squeezing finger pads 34*a* and 34*b* together, e.g., by a thumb and forefinger, the locking pins 30*a* and 30*b* rotate about the pin 32 to separate the engaging portions 31*a* and 31*b* against the force of the spring 33. In this disengaged position, the toe pad 15 may be moved along a heel-to-toe direction and the finger pads 34*a* and 34*b* are released. The spring 33 then urges the engaging portions 31*a* and 31*b* toward each other so that the engaging portions 31*a* and 31*b* may engage with teeth 41 on a rack 40 attached to the base 11. Once the locking pins 30*a* and 30*b* are engaged with the rack 40, the toe pad 15 cannot be moved relative to the base 11 unless the finger pads 34*a* and 34*b* are again squeezed toward each other to disengage the locking pins 30*a* and 30*b* from the rack 40.

Figure 10:
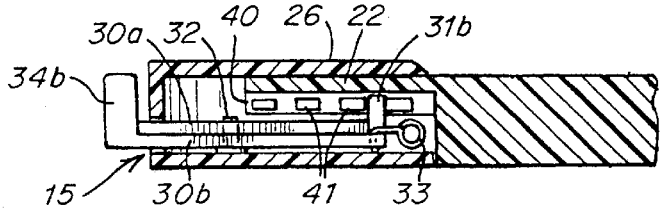
FIG. 10 is a side view of the binding of FIG. 9.

FIG. 10 shows a side view of the embodiment of FIG. 9. In this embodiment, the engaging portions 31*a* and 31*b* are formed by upwardly extending portions of the locking pins 30*a* and 30*b*. The rack 40 is attached to, or is formed as part of, an underside of the extension 22 from the base 11. The teeth 41 in this embodiment are shown as rectangular blocks extending from opposite sides of the rack 40. The teeth 41 could take other forms, such as serrations, or could be replaced with holes, grooves or other features formed in the rack 40. Therefore, the engaging portions 31*a* and 31*b* may take different forms depending upon the type of features on the rack 40. For example, if the rack 40 has a plurality of holes formed along the rack 40, the engaging portions 31*a* and 31*b* may have pins that engage with the holes. The locking pins 30*a* and 30*b* need not be rotatably attached at a pin 32 mounted on the toe pad 15. Instead, the locking pins 30*a* and 30*b* may be formed of a spring steel or other elastic material and are fixed to each other at a central point, such as at a point near that shown for the location of the pin 32, or are connected to each other by a beam, living hinge or other element near a central point. Thus, when the finger pads 34*a* and 34*b* are squeezed together, the squeezing force can be transmitted to the joint between the locking pins 30*a* and 30*b* to move the engaging portions 31*a* and 31*b* away from each other. In such a case, the spring 33 may be omitted. The spring 33 may also be moved to other locations, such as a point between the finger pads 34*a* and 34*b* and the pin 32 (in which case the spring 33 would be compressed when the finger pads 34*a* and 34*b* are squeezed together), or the spring 33 may be a rotary spring located at the pin 32 that places a rotational force on one or both of the locking pins 30*a* and 30*b*.

Other locking pin arrangements will occur to those in the art. For example, one or more locking pins 30 may be mounted to the toe pad 15 to rotate around an axis perpendicular to the heel-to-toe direction and parallel to an upper surface of the snowboard. The locking pin 30 can be spring loaded so that the locking pin 30 is biased to urge an engaging portion 31 into engagement with a hole or other feature on an under surface of an extension 22. A finger pad 34 may be provided at an end of the locking pin 30 near a front of the toe pad 15 so that a rider can lift the finger pad 34 to disengage the locking pin 30 from the extension 22 and move the toe pad 15 to another position.

As another example, the locking pins 30*a* and 30*b* of the embodiment of FIGS. 9 and 10 could be arranged to frictionally engage with a rack 40 that has no teeth 31 or other features, but instead has a pair of nearly parallel, flat faces. The locking pins 30*a* and 30*b* may be arranged in a way similar to a pair of locking pliers so that when the locking pins 30*a* and 30*b* are actuated, e.g., by squeezing the finger pads 34*a* and 34*b* together either with a tool or by fingers alone, the engaging portions 31*a* and 31*b* are moved forcefully toward each other to frictionally engage with a corresponding flat surface of the rack 40. The toe pad 15 may be moved by disengaging the locking pins 30*a* and 30*b,* e.g., by separating the finger pads 34*a* and 34*b* apart, thereby disengaging the engaging portions 31*a* and 31*b* from the rack 40. In this embodiment, the toe pad 15 may be adjusted to one of an infinite number of possible positions relative to the base 11.

Figure 11:
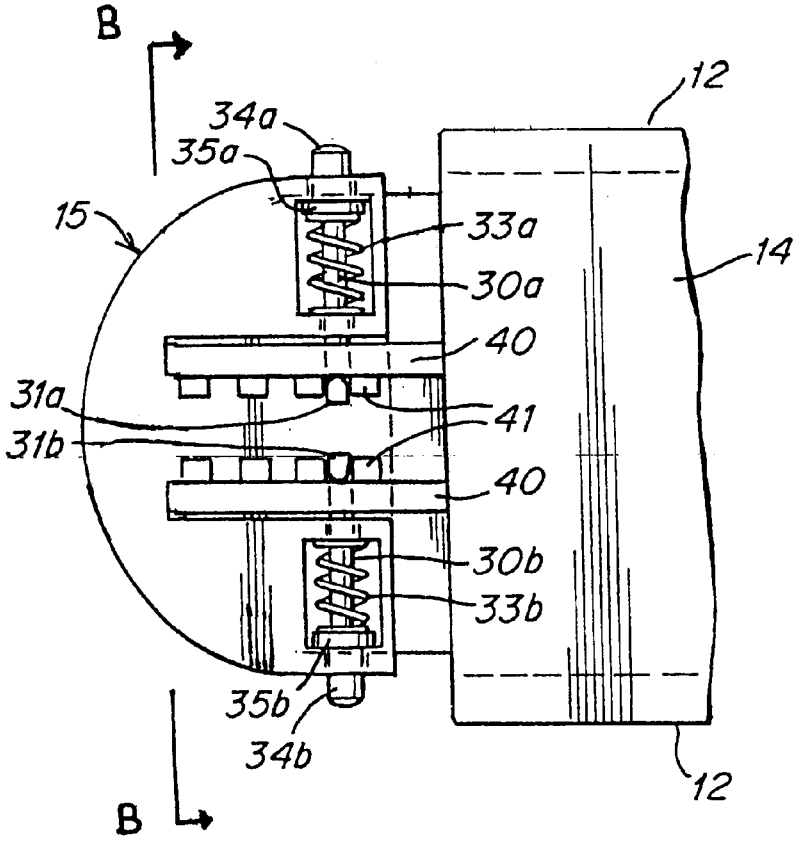
FIG. 11 shows a schematic top view of an alternative embodiment of a snowboard binding having manually-operated locking pins.

FIG. 11 shows another embodiment in which locking pins 30*a* and 30*b* extend in a direction perpendicular to the heel-to-toe direction in the toe pad 15. Each of the locking pins 30*a* and 30*b* include a finger pad 34*a* and 34*b* that can be depressed by a rider to move the locking pins 30*a* and 30*b* toward a center of the toe pad 15. This movement causes the engaging portions 31*a* and 31*b* to move toward each other and disengage from teeth 41 on a corresponding rack 40. Pressure on the finger pads 34*a* and 34*b* compresses the springs 33*a* and 33*b,* which normally urge the locking pins 30*a* and 30*b* to move away from a center of the toe pad 15. Shoulders 35*a* and 35*b* on the finger pads 34*a* and 34*b* contact the toe pad 15 and prevent the locking pins 30*a* and 30*b* from being pushed out from the toe pad 15 by the springs 33*a* and 33*b.*

Figure 12:
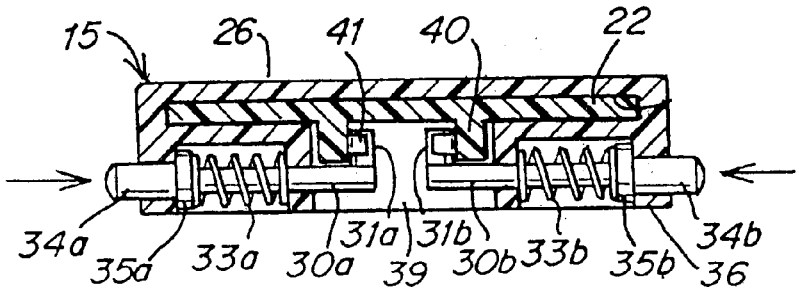
FIG. 12 is a cross-sectional schematic front view of the embodiment of FIG. 11.

FIG. 12 shows a cross-sectional schematic view of the toe pad 15 along the line B—B in FIG. 11. In this embodiment, the engaging portions 31*a* and 31*b* are upwardly extending portions of the locking pins 30*a* and 30*b.* When the finger pads 34*a* and 34*b* are depressed, the engaging portions 31*a* and 31*b* move toward each other to disengage from the rack 40 to allow movement of the toe pad 15. As in the illustrative embodiment shown in FIGS. 9 and 10, the locking pins 30 may be actuated with or without tools, and the teeth 41 on the rack 40 can be replaced with other features, such as grooves, serrations or holes. The rack 40 may also be replaced with a single rack 40, as is the case in FIG. 9. Further, in the embodiments shown in FIGS. 9–11, the toe pad 15 may include only one locking pin 30, since two locking pins 30*a* and 30*b* are not required.

As in the embodiments shown in FIGS. 2–7, the embodiments shown in FIGS. 9–11 may be positioned between a top surface 141 of a bottom 14 of the base 11 and a bottom surface 142 of the base 11. Such positioning may provide the benefits described above of shielding the locking device from foreign matter and/or hiding portions of the locking device from view.

Having described certain embodiments of the present invention, various alterations, modifications, and improvements will readily occur to those skilled in the art.

It should be understood that position adjustment of a toe pad, whether tool-free or not, can be provided in a variety of ways and using different devices than those shown in the illustrative embodiments described above. In addition, the invention is not limited to use with snowboards, but may be used with other types of bindings, such as those used for snowshoes, skis, or other applications in which a foot is bound to a device other than a snowboard. Therefore, such alterations, modifications and improvements are intended to be within the sprit and scope of the invention. Accordingly, the foregoing description is by way of example only, and not intended to be limiting.

What is claimed is:

1. A snowboard binding comprising:

a base adapted to be mounted on a snowboard and to support a bottom of a rider's foot, the base including a bottom having a bottom surface to contact an upper surface of a snowboard, and a top surface opposite the bottom surface and near a bottom of a rider's foot supported by the base;

a pad mounted to the base; and a positioner adapted to position the pad at one of a plurality of positions relative to the base while the base is mounted to a snowboard, the positioner including a locking device having at least one locking pin movable to selectively hold the pad at one of the plurality of positions, the locking device located entirely between planes including the top and bottom surfaces.

2. The binding of claim 1, wherein the positioner provides tool-free adjustment of the pad relative to the base.

3. The binding of claim 1, wherein the positioner allows the pad to be adjusted to one of an infinite number of positions relative to the base.

4. The binding of claim 1, wherein the positioner allows the pad to be adjusted to one of an infinite number of positions relative to the base.

5. The binding of claim 1, wherein:

the at least one locking pin is located under an upper surface of the pad.

6. The binding of claim 1, wherein:

the base includes at least one extension near a toe end of the base; and the pad includes a slot adapted to receive the extension on the base.

7. The binding of claim 1, wherein:

the locking device locks the pad into one of a plurality of positions relative to the base.

8. The binding of claim 7, wherein the locking device provides tool-free adjustment of the pad relative to the base.

9. The binding of claim 7, wherein the locking device allows the pad to be adjusted to one of an infinite number of positions relative to the base.

10. The binding of claim 7, wherein:

the at least one locking pin is adapted to engage with two or more different portions of the base.

11. The binding of claim 1, wherein the locking device includes two locking pins that are arranged to pivot relative to each other, the locking pins comprising, an engaging portion adapted to engage with the base at at least two positions, and a finger pad connected to the engaging portion, wherein when the finger pads on the locking pins are urged to move relative to each other, the locking pins pivot relative to each other and move to disengage the engaging portions from the base.

12. The binding of claim 1, wherein the locking device includes at least one locking pin movable in a direction perpendicular to a heel-to-toe direction.

13. The binding of claim 1, wherein the positioner is adapted to allow adjustment of a position of the pad to one of an infinite number of heel-to-toe positions relative to the base.

14. The binding of claim 1, wherein the positioner is adapted to allow tool-free adjustment of the pad relative to the base in a heel-to-toe direction.

15. A snowboard binding comprising:

a base adapted to be mounted on a snowboard and to support a bottom of a rider's foot, the base including a bottom having a bottom surface to contact an upper surface of a snowboard, and a top surface opposite the bottom surface and near a bottom of a rider's foot supported by the base;

a pad mounted to the base;

a positioner adapted to position the pad at one of a plurality of positions relative to the base while the base is mounted to a snowboard, the positioner including a locking device having at least one locking pin movable to selectively hold the pad at one of the plurality of positions;

a spring that urges the at least one locking pin into engagement with at least one portion of the base; and a finger pad attached to the locking pin that can be pressed to disengage the locking pin.

16. A pad adapted to be supported by a binding base attached to a snowboard, the binding base having a bottom including a top surface opposite a bottom surface that contacts the snowboard, the pad comprising:

a pad body having an upper surface adapted to provide support to a portion of a bottom of a rider's foot; and a positioner adapted to selectively position the pad at one of a plurality of positions relative to a binding base while the base is mounted to the snowboard, the positioner including a locking device with at least one locking pin movable to selectively hold the pad at one of the plurality of positions, the locking device being located entirely between planes including the top and bottom surfaces of the bottom of the binding base when the pad is supported by the binding base.

17. The pad of claim 16, wherein the positioner provides tool-free adjustment of the pad relative to the base.

18. The pad of claim 17, wherein the positioner allows the pad to be adjusted to one of an infinite number of positions relative to the base.

19. The pad of claim 16, wherein the positioner allows the pad to be adjusted to one of an infinite number of positions relative to the base.

20. The pad of claim 16, wherein:

the at least one locking pin is located under an upper surface of the pad.

21. The pad of claim 16, wherein:

the base includes at least one extension near a toe end of the base; and the pad includes a slot adapted to receive the extension on the base.

22. The pad of claim 16, wherein:

the locking device locks the pad into one of a plurality of positions relative to the base.

23. The pad of claim 22, wherein the locking device provides tool-free adjustment of the pad relative to the base.

24. The pad of claim 22, wherein the locking device allows the pad to be adjusted to one of an infinite number of positions relative to the base.

25. The pad of claim 22, wherein:

the at least one locking pin is adapted to engage with two or more different portions of the base.

26. The pad of claim 16, wherein the locking device includes two locking pins that are arranged to pivot relative to each other, the locking pins comprising, an engaging portion adapted to engage with the base at at least two positions, and a finger pad connected to the engaging portion, wherein when the finger pads on the locking pins are urged to move relative to the pad, the locking pins pivot and move to disengage the engaging portions from the base.

27. The pad of claim 16, wherein the locking device includes at least one locking pin movable in a direction perpendicular to a heel-to-toe direction.

28. The pad of claim 16, wherein the positioner is adapted to allow adjustment of a position of the pad to one of an infinite number of heel-to-toe positions relative to the base.

29. The pad of claim 16, wherein the positioner is adapted to allow tool-free adjustment of the pad relative to the base in a heel-to-toe direction.

30. A pad adapted to be supported by a binding base attached to a snowboard, the binding base having a bottom including a top surface opposite a bottom surface that contacts the snowboard, the pad comprising:

a pad body having an upper surface adapted to provide support to a portion of a bottom of a rider's foot;

a positioner adapted to selectively position the pad at one of a plurality of positions relative to a binding base while the base is mounted to the snowboard, the positioner including a locking device with at least one locking pin movable to selectively hold the pad at one of the plurality of positions;

a spring that urges the at least one locking pin into engagement with at least one portion of the base; and a finger pad attached to the locking pin that can be pressed to disengage the locking pin.

31. A binding base comprising:

means for attaching the binding base to a snowboard, the means for attaching including a bottom having a bottom surface to contact an upper surface of the snowboard, and a top surface opposite the bottom surface;

means for securing a rider's foot to the snowboard; and means for engaging with a positioner in a pad adapted to be mounted to the binding base and to allow selective adjustment of the pad on the binding base while the base is mounted to the snowboard, the positioner and the means for engaging being positioned in the pad such that when the pad is mounted to the binding base, the positioner and the means for engaging are positioned entirely between planes including the top and bottom surfaces of the bottom of the binding base, the means for engaging adapted to engage with a portion of a locking pin of the positioner to hold the pad at a selected position relative to the binding base.

32. The binding base of claim 31, wherein:

the means for engaging comprises a feature adapted to engage with a locking pin in the positioner.

33. A method for adjusting a pad on a snowboard binding, comprising:

providing a binding having a base attached to a snowboard;

providing a pad mounted to the base, the pad being adapted to support only a portion of a bottom of a rider's foot;

disengaging a locking pin movably mounted relative to the base by moving the locking pin against a spring bias to release the pad at a first position relative to the base; and selectively positioning only the pad relative to the base to a second position while the base is attached to the snowboard, without dismounting the pad from the base.

34. The method of claim 33, wherein the step of disengaging comprises:

disengaging a locking pin mounted to the pad from the base.

35. The method of claim 33, wherein the step of disengaging comprises:

moving a pair of locking pins toward each other to disengage the locking pins from the base.

36. A snowboard binding, comprising:

binding means for securing a rider's foot to a snowboard, the binding means attached to a snowboard;

pad means for supporting the rider's foot in the binding means, the pad means being adapted to support only a portion of the rider's foot; and means for selectively positioning only the pad means at one of a plurality of positions relative to the binding means while the binding means is attached to the snowboard, without tools and without dismounting the pad means from the base, the means for selectively positioning including at least one locking pin movably mounted and spring biased to selectively hold the pad at one of the plurality of positions.

37. A snowboard binding comprising:

a base adapted to be mounted on a snowboard and to receive a rider's foot;

a pad mounted to the base, the pad being adapted to support only a portion of the rider's foot; and a pad positioner that selectively positions only the pad at one of a plurality of positions relative to the base while the base is attached to the snowboard, without dismounting the pad from the base, the positioner including at least one locking pin mounted to move relative to the base under the force of a resilient member and to selectively hold the pad at one of the plurality of positions.

38. The binding of claim 37, wherein:

the pad positioner comprises a locking device that locks the pad into one of a plurality of positions relative to the base.

39. The binding of claim 38, wherein:

the locking device comprises at least one locking pin adapted to engage with two or more different portions of the base.

40. The binding of claim 37, wherein the pad positioner provides tool-free adjustment of the pad relative to the base.

41. The binding of claim 37, wherein the pad positioner allows the pad to be adjusted to one of an infinite number of positions relative to the base.

42. A snowboard binding comprising:

a base adapted to be mounted on a snowboard and to receive a rider's foot;

a pad mounted to the base; and a pad positioner adapted to position the pad at one of a finite plurality of discrete positions relative to the base while the base is attached to the snowboard, the pad positioner including a locking device with two locking pins movably mounted to the pad, each of the locking pins including at least one engaging portion that is resiliently biased to engage with a portion of the base to hold the pad at one of the discrete positions.

43. A snowboard binding comprising:

a base adapted to be mounted on a snowboard and to receive a rider's foot;

a pad mounted to the base; and a pad positioner adapted to position the pad at one of a finite plurality of discrete positions relative to the base while the base is attached to the snowboard and without requiring tools, the pad positioner including a locking device with two locking pins movably mounted to the pad, each of the locking pins comprising, an engaging portion adapted to engage with the base at at least two positions, and a finger pad connected to the engaging portion, wherein when the finger pads on the locking pins are urged to move relative to each other, the locking pins pivot relative to each other and move to disengage the engaging portions from the base.

44. The binding of claim 43, wherein the two locking pins are pivotally mounted by a living hinge element.

45. The binding of claim 43, wherein the finger pads are located near a toe end of the pad.

46. The binding of claim 43, wherein the two locking pins are normally biased to move an engaging portion toward engagement with the base.

47. The binding of claim 43, wherein when the finger pads are urged to move toward each other, the two locking pins pivot about an axis perpendicular to a heel-to-toe direction and the engaging portions move away from each other.

* * * * *